US005630342A

United States Patent [19]

Owoc

[11] Patent Number: 5,630,342

[45] Date of Patent: May 20, 1997

[54] RATCHET WRENCHES COMPRISING RATCHER GEARS/ROTATABLE PAWLS THAT EMBODY U-JOINTED, LOCKED SOCKET DRIVE TANGS

[76] Inventor: Gregory J. Owoc, 101 White Oak Rd. (B-4), Greenville, S.C. 29609

[21] Appl. No.: 567,734

[22] Filed: Dec. 5, 1995

Related U.S. Application Data

[63] Continuation of Ser. No. 359,933, Dec. 20, 1994, abandoned, and a continuation of Ser. No. 62,819, May 14, 1993, abandoned.

[51] Int. Cl.[6] ..... B25B 13/46

[52] U.S. Cl. ..... 81/57.39; 81/63.2; 81/177.75

[58] Field of Search ..... 81/60–63.2, 177.75, 81/57.39

[56] References Cited

U.S. PATENT DOCUMENTS

| | | | |
|---|---|---|---|
| 1,167,948 | 1/1916 | Starrett et al. | 81/63.2 X |
| 1,431,064 | 10/1922 | Treisch | 81/63.2 |
| 3,269,496 | 8/1966 | Kilness | 81/63.2 X |
| 3,802,302 | 4/1974 | Bengtson | 81/177.75 X |
| 4,034,574 | 7/1977 | Kuder | 81/177.75 X |
| 4,108,027 | 8/1978 | Lenker | 81/177.75 X |
| 4,147,076 | 4/1979 | Wright et al. | 81/63.2 |
| 4,722,252 | 2/1988 | Fulcher et al. | 81/57.39 |
| 4,941,862 | 7/1990 | Hazebrook et al. | 81/177.75 X |

*Primary Examiner*—James G. Smith
*Attorney, Agent, or Firm*—Hardaway Law Firm, P.A.

[57] ABSTRACT

Standard ratchet wrenches are improved by including swiveling socket drive-tangs within their rotatable drive components. In wrenches using rotatable ratchet gears, the gear comprises a bore and pin that receives a slotted ball tang. The bore further may be threaded to receive a threaded locking bolt that serves to bias the ball tang into a gradual to full locking position. A press and lock button is also described. The invention is depicted in ratchet wrenches using rotatable pawls and in pneumatic drive wrenches which may use either rotatable pawls or gears. Various modifications of the wrenches' components are described and illustrated, as well.

19 Claims, 8 Drawing Sheets

RATCHET WRENCHES COMPRISING RATCHER GEARS/ROTATABLE PAWLS THAT EMBODY U-JOINTED, LOCKED SOCKET DRIVE TANGS

This application is a file wrapper continuation, of application Ser. No. 08/359,933, filed Dec. 20, 1994 abandoned and a continuation of Ser. No. 08/062,819, filed May 14, 1993, abandoned.

BACKGROUND

1. Field of Invention

The present invention discloses ratchet wrenches which include the useful and novel, additional structure of a universal joint (Herein after the terms universal joint or U-joint shall be considered to encompass constant velocity joints, block and pin Hooke's Type U-joints and swivel ball type U-joints.), integrally affixed to the rotatable member of the wrench; In one ratchet wrench, to the rotatable, dual-directional ratchet gear, and in the other wrenches, to the rotatable, dual-directional ratchet pawl.

The standard, block and pin type U-joint, which is a simple adaptation of the old Hooke's coupling, and is the prevalently used detachable U-joint in the hand tool industry, though described and illustrated as a viable structural option is, however, an unlikely candidate for mass production and use, primarily because of its excessive length and structural awkwardness in the application of locking means thereto.

As well, C V joints, primarily developed for the automotive industry, specifically for front-wheel drive vehicles, are optional U-joint structures that may potentially execute this invention. The Weiss Joint, the Rzeppa Joint and the Tracta Joint, patented in 1925, 1928, 1933 respectively, or various modifications of these U-joints in use today are however, like the block and pin type U-joint, also unlikely mass-producible candidates. This is primarily due to the fact that the slight benefit constant velocity provides in torqueing fasteners will not likely justify the increased complexity and cost and, as well, offset the minimal working angle, (around 15°) characteristic of C V Joints.

The preferable U-joint for this application would comprise variations of the swivel ball type, which generally comprise a hinge pin and slot in the swivel ball to facilitate swiveling motion of the tang. This type of U-joint is widely used for power tool applications where added strength and compactness are added advantages. These U-joints generally provide a smaller working angle than the said block and pin type. A 30° angle is typical and is defined as the degree of the swiveling angle off of the central axis of the socket. The invention disclosed would preferably utilize improved embodiments of this type of swivel U-joint, which in some cases would retain practically all of the strength per size ratio and, as well, add 15° to the working angle, providing a full 45° working angle. Also, this joint would be optionally lockable into a rigid, generally perpendicular axis with respect to the wrench head, since in the majority of times, the wrench user will not need the access advantage to normally accessible fasteners.

2. Prior Art

Prior art, being only remotely related to the subject invention, would include U.S. Pat. No. 4,114,401, in which a U-joint embodies an oscillating drive pin whereby a ball-receiving bore in a socket having diametrically opposing slots receives a swivel ball. The swivel ball comprises a pin rigidly extended both through its center and outward on both sides. Swiveling motion may be achieved as the ball may swing fore and aft in one E–W direction, while the pins in the slots enable the wrench tang's cylindrical coupling structure to swing in a correspondingly N–S direction, as the pins are guided in the slots. A major problem with the U-joint is the necessary apparatus that would be required to retain the ball and pin in its respective slotted holder during larger working angle torquing. Though the structure could withstand significant torque loads, it appears that the structure could only provide a maximum 20° working angle, thus limiting its usefulness.

U.S. Pat. No. 3,855,884 discloses a locking U-joint and is cited because the subject invention includes various swivel joint, tang locking means. This patent comprises a socket sleeve which is axially slidable along an inner shaft portion central to the U-joint. The sleeve rim opposite the socket sleeve end abuts the rim of the cavity that retains the ball of the U-joint when the U-joint is locked; When the sleeve rim separates contact from the ball joint cavity rim, the ball joint and inner shaft cooperate as a normal U-joint. The locking means of the subject invention acts however, not upon a shaft means and joint cavity rim but directly upon the socket tang support means located at the opposite end of the socket drive tang. In addition, this patent is cited because it demonstrates the usefulness of a lockable U-joint means.

U.S. Pat. No. 4,936,701 depicts a useful U-joint comprising a rotatable sleeve whereby a wrench user, primarily of power wrenches, i.e., pneumatic, electric, etc., may grasp the joint while torquing a fastener, since the sleeve may remain stationary in the hand while the joint and applicable appendaged socket or socket tang and socket rotate. As in previously discussed U.S. Pat. No. 4,114,401, a swivel ball means is retained in cavity by a support means. However, the pin in this embodiment is fixed relative to the U-joint body and the ball joint is slotted to allow a rocking or swiveling motion upon the said pin support means. The working angle of this U-joint means is in the 30° range and the ball joint is spring loaded to bias the socketing portion (i.e., tang or appendaged socket) to linear alignment to the core or central axis of the socket body.

From the above discussed prior art, it is evident that genuine efforts have been expended to produce an improved U-joint that is stronger, having a locking feature and also spring biasing the tang towards the linear structure of the U-joint. However the novel invention of including a permanently affixed U-joint within a ratchet wrench that includes the feature of either gradual to complete swivel tang lockability or quick, direct lockability is quite new to the hand tool field. As well, the above U-joints are cited as art that is distantly related to the basic subject invention.

It is an object of this invention to facilitate the introduction of a variety of potentially useful U-joints into either a dual-directionally rotatable ratchet gear means or into a dual-directionally rotatable ratchet pawl means. This improvement would greatly enhance the maneuverability of these wrenches, significantly lessening the need for detatchable U-joint adapters or U-joint sockets.

It is an object of this invention to provide the novel swivel tang ratchets with several tang position locking means so that when the swivelling tang is not needed the wrench user may turn, press or slide an atuator on the wrench, (preferably on the wrench head) that would enable one to engage this optional tang locking effect at will.

It is an object of this invention to provide the above discussed locking apparatuses with a variable or gradual tang locking position so that the total said working angle may be gradually reduced at will, to the desired angle.

It is also an object of this invention to provide the above improved ratchet wrenches with a biasing means so that the socket drive tang would continually be biased in a normal position, generally perpendicular to the wrench body.

It is an object of the invention to focus in on a preferable, swivel tang ratchet structure comprising a generally spherical swivel-jointed socket tang and a socket drive tang support means for said socket tang that is of a swivel pin type and is of few, uncomplex and reliable parts that is easily manufactured and may be rapidly assembled.

SUMMARY

The present ratchet invention may be summarized as follows: A ratchet wrench that comprises a torquable grasping means such as a handle or stubbed ratchet wrench head that may include a detatchable handle or torque bar lever means or even a wrench handle serving as a housing for a pneumatically controlled drive means for the drive tang. These torquable grasping means, hereinafter also referred to as a ratchet wrench handle, ratchet handle or wrench handle, would have a head portion that would comprise a cylindrical recess. IN one preferred embodiment this cylindrical recess would receive a dual-directionally rotatble ratchet gear means. The said ratchet gear means would comprise within itself a cavity that was spherical and/or generally cylindrical in dimension. The said cavity would comprise a U-jointed, socket drive tang support means. This drive means would preferably take the structure of a main pin means, hereinafter referred to also as a swivel pin that is either stationarily and rotatably supported or stationarily and rigidly supported along the horizontal axis of the cavity. The socket drive tang means would include at its opposite end (where the square socket drive tang and a biased socket locking ballbearing located therein), a generally spherical portion that may be structurally configured in several ways so that the said swivel pin means may swivelably receive the said generally spherical portion.

In one preferable configuration, the said spherical portion, which also is referred to as a swivel ball portion, would comprise an elongate aperture wherethrough the said pin means insert. The elongate aperture would comprise the type of bore that would enable the said socket drive tang to swivel to about a 30°+ work angle from off of the central axis of the U-joint.

In a second preferable swivel ball configuration the work angle of the U-joint may be increased without increasing the size of the components and sacrificing strength (actually, strength may be enhanced by this second preferred structure). The pin means would be modified to include within its center a donut portion. The said generally spherical portion end of the said socket drive tang compriese the structure of a bifurcated ball joint, whereby the two sides of the ball provide semi-spherical pivot support means consisting of two prongs extending upward from the socket tang's said opposite end. These said pivot prongs have both sides of the said donut portion intervening them with the said pin means extending in a manner, preferably non-rotatably through apertures in the center of each said prong and rotatably through the said donut portion aperture, rotatably supporting said donut portion and said socket drive tang. Since the horizontal axes of both the said pin support means intersect generally at right angles, and since the said support prongs cover the whole side of the said donut portion, a very sturdy socket drive tang swivel mounted means that can swivel to work angles of 45° and beyond is supplied through this particular structural arrangement of the subject invention. Of course, the said donut portion may be instead included on the ball socket tang end and the main pin means would then comprise a receiving slot within a ball portion interposed between two pin ends.

In a like manner, as will be discussed in the description below, the rotatable pawl may just as easily comprise a similar cavity to support the aforesaid swivel U-joint structure.

The tang drive locking means may comprise several configurations:

A preferred structure would comprise mating locking surfaces whereby a female conical indenture in the head of said swivel ball end of the socket tang and a male conical protuberance, as part of a threaded piece may be screwed down upon or otherwise urged by a wrench user to engage both said conical portions into a gradually locking or into a one stage swivel lock position.

Instead of conical mating surfaces, a myriad of other male/female locking structures, gradual or one stage, may be used to execute the subject invention. For instance, multiple or single prongs with matable slots or even two flat-faced surfaces that may be pressed in to mutually flush surface contact may be used to effect a desired locking position.

As well, spring biased means to continually urge the said socket tang to a normal perpendicular position with respect to the longitudinal axis of the wrench means may be included. Various coil springs, band or leaf springs could easily serve for this function.

Finally, other basic, less preferred and various U-joint configurations will be depicted and described so as to indicate the broad scope of the subject invention. As well, the above summary is general and serves as an overview of the invention. Further features and modifications besides those summarized above will be described in the following description. Due to the fact that the invention encompasses a broad scope with the field of hand tools, ratchet wrenches and universal joint apparatuses, it should be obvious to one skilled in present art to see possible general modifications that may be substituted for those employed to achieve the purposes of the present invention, while not departing from the spirit or scope of the present invention.

DETAILED DESCRIPTION OF THE PREFERRED EMBODIMENTS

Figure 1:
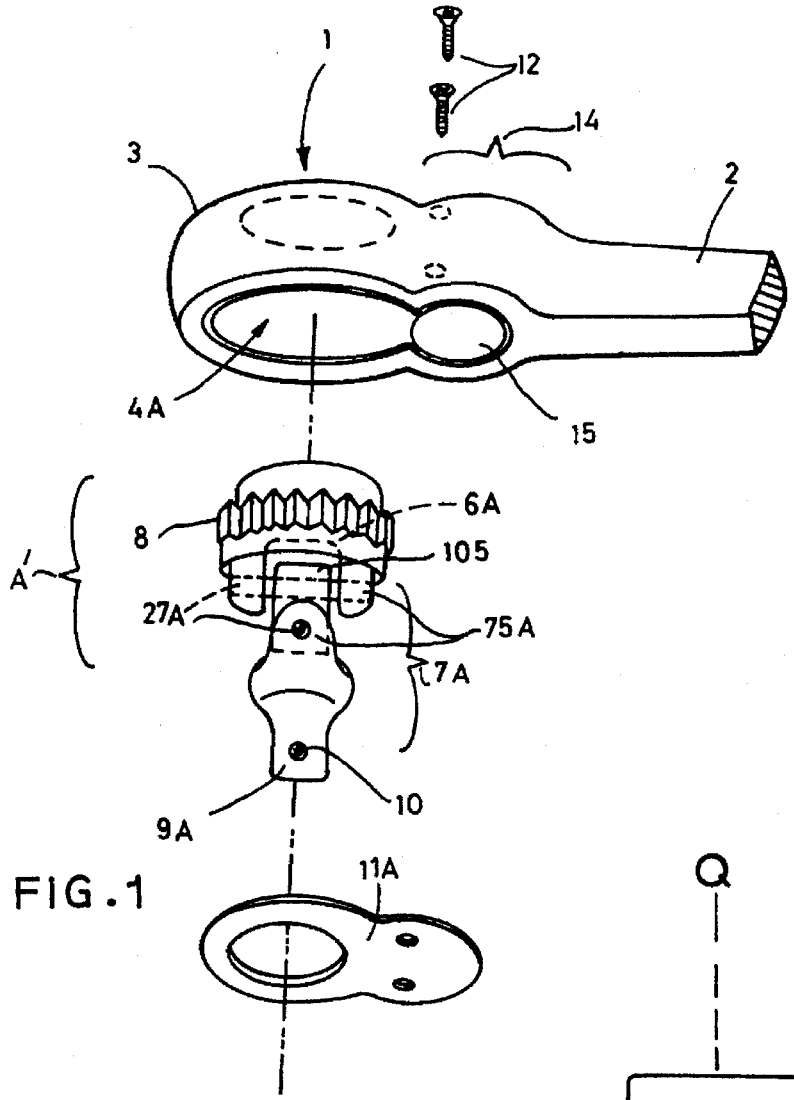
FIG. 1 is an exploded angular perspective drawing of a block and pin type U-joint socket tang affixed within a ratchet wrench's rotatable ratchet gear.

In describing the preferred embodiments of the invention illustrated in the drawings and summarized above, specific terminology will be resorted to for sake of clarity. However, it is intended not to be limited to the specific terms so selected and it is to be understood that each specific term includes all technical equivalents which operate in a similar to accomplish a similar purpose.

With reference to the basic invention of FIG. 1, note ratchet wrench 1 comprising torquable grasping means 2 hereinafter also referred to as a ratchet wrench handle 2 or ratchet handle which includes a head portion 3 that has a cylindrical recess 4A. This cylindrical recess 4A receives a dual-directionally rotatable ratchet gear U-joint means A' hereinafter also referred to as U-joint ratachet gear A'. Said U-joint ratchet gear A' comprises an integral gear 8 cavity 6A and U-joint socket drive tang support means 7A referred to hereinafter also as socket tang swivel mount means 7A provides swiveling, U-joint motion to socket drive tang 9A which comprises socket locking, biased ballbearing 10A. Said swivel mount means 7A further comprises a block 105 and pins 27A with pin supports 75A. Said U-joint ratchet gear A' is rotatably secured upon said cylindrical recess 4 by support piece 11A which is itself retained in position by bolt means 12. Pawl mechanism cavity 14 comprises pawl mechanism 15 which is operable with said integral ratchet gear 8 during operation of said ratchet wrench 1. As anyone skilled in the art could realize, FIG. 1 comprises a basic U-joint ratchet gear structure which can be modified to adapt to nearly every single one of the fifty or more various ratchet wrench structures utilizing a rotatable ratchet gear and stationary pawl configuration. And the embodiment depicted in FIG. 1 is simply a workable basic structure demonstrating the scope of the invention, developed into more viable apparatuses shown in subsequent Figures herein. Also, FIGS. 1, 4, 4A, 5, 5A, 6A, 6B, 6C, and 7 comprise the first preferred ratchet wrench embodiments. Whereas, FIG. 2 is a second preferred embodiment and FIG. 3 is the invention's third preferred embodiment.

Figure 2:
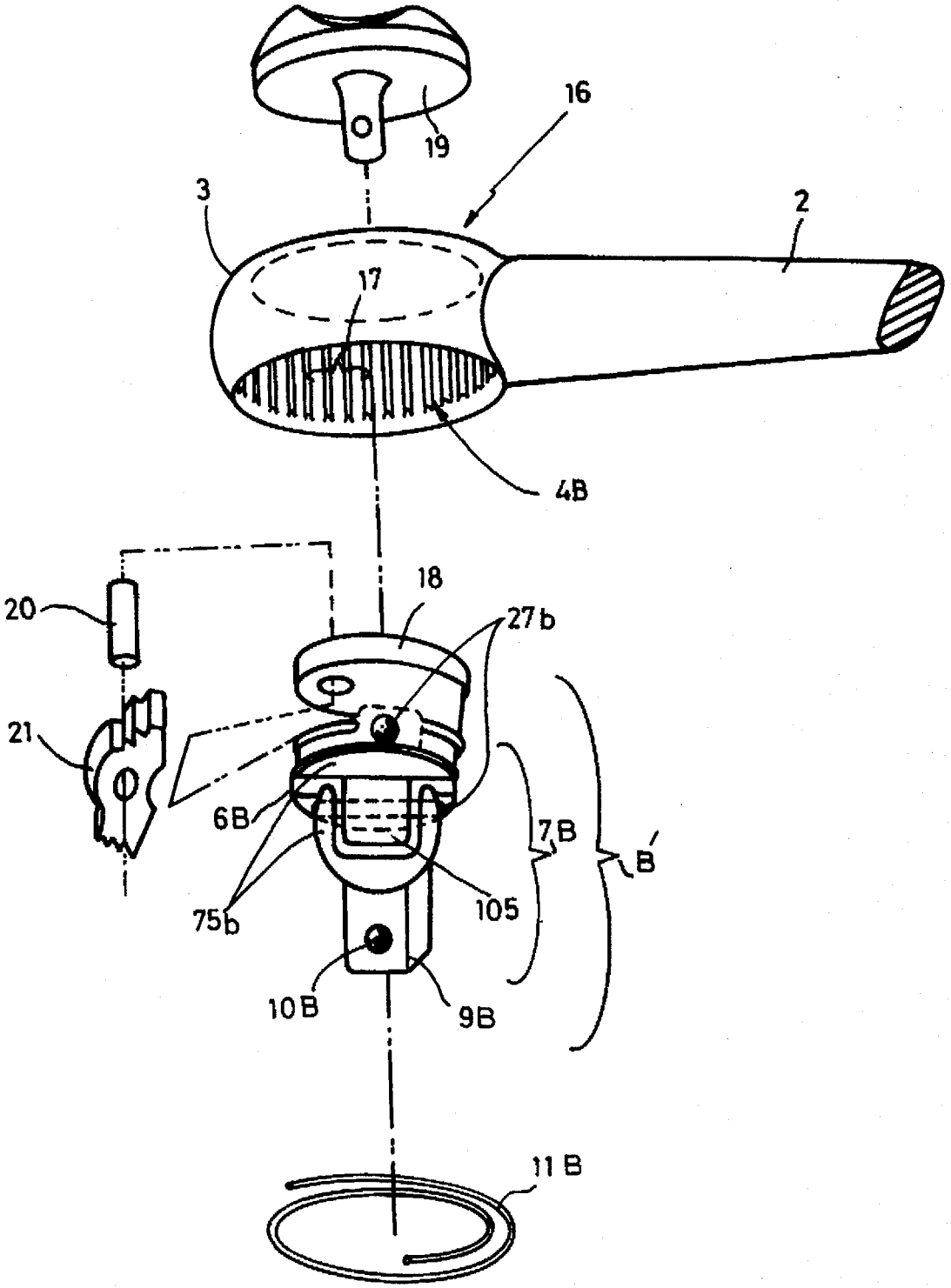
FIG. 2 is an exploded angular perspective drawing of a block and pin type U-joint socket tang affixed within a ratchet wrench's rotatable pawl mechanism or means.

FIG. 2 depicts ratchet wrench 16 comprising a said head portion 3 that includes a said cylindrical recess 4B with ratchet gear teeth 17 circumscribing the inside circumference of said cylindrical recess 4, which recess 4 receives a dual-directionally rotatable ratchet pawl u-joint socket drive means B', hereinafter also referred to as a U-joint ratchet pawl B', which is shown comprising an integral ratchet pawl 18 and cavity 6B. U-joint socket drive tang support means 7B, hereinafter also referred to and defined as a socket drive swivel mount means 7B, further comprising said block 105, pins 27B and pin supports 75B, provides swiveling U-joint motion to socket drive tang 9B, which itself comprises locking, biased ballbearing 10B Said U-joint ratchet pawl B' is rotatably secured in said cylindrical recess 4B by annular retaining means 11B. Pawl actuator 19 engages oscillating pawl component 21 which oscillates on oscillatory support means 20.

Figure 1A:
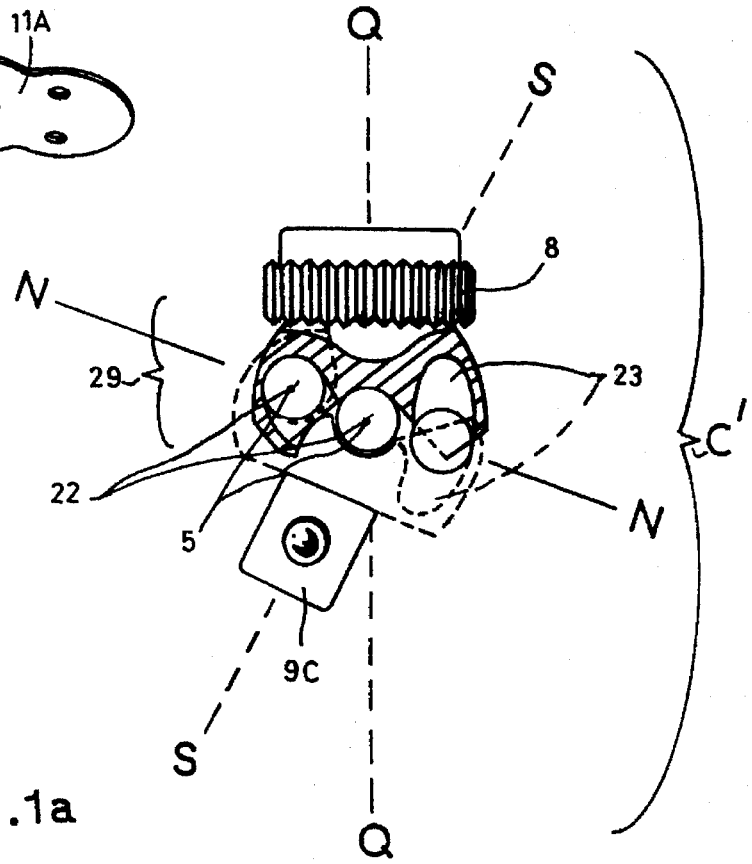
FIG. 1A is a flat cutaway perspective drawing a constant velocity U-joint socket tang affixed within a rotatable ratchet gear.

FIG. 1A comprises a ratchet gear having a socket drive swivel mount means 29 utilizing a U-joint C' which provides constant angular velocity in rotation of socket tang 9C. The well known joint used in front-wheel drive automobiles is technically known as a Bendix-Weiss joint. Since plane N—N passes through the centers of the five balls 22 (two not shown) in yoke grooves 23, the centers 5 always bisect the angle created when plane Q—Q and plane S—S intersect during angular torquing of a fastener, thus providing constant velocity to the said socket tang 9C.

Figure 3:
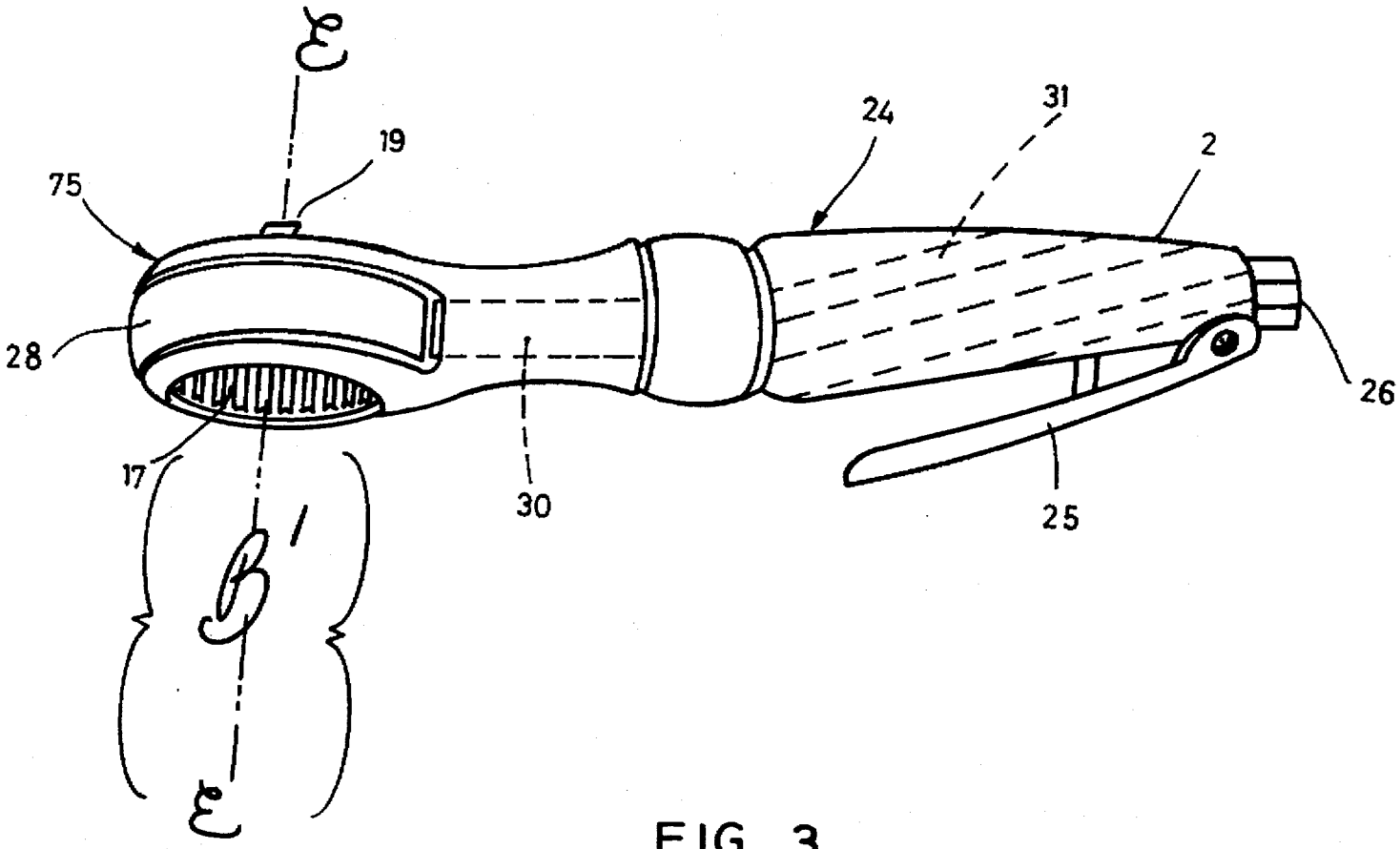
FIG. 3 is an exploded angular perspective drawing of a pneumatic ratchet wrench adaptable to incorporate primarily the said block and pin type U-joint socket tang and respective rotatable pawl of FIG. 2.

FIG. 3 comprises pneumatic or air powered ratchet wrench 24, with air intake port 26, trigger 25, drive vanes 31, drive piston means 30, said pawl actuator 19, said ratchet gear teeth 17, and ratchet gear teeth head portion 28. This type of air wrench is in widespread use in the power hand tool industry and may easily utilize a similar said ratchet pawl U-joint means B' as described in FIG. 2 and may be inserted into wrench head 75 along axis E—E.

Moreso than FIGS. 1 and 2, the remaining FIGS. 4 through 7 provide a more efficient, useful U-jointed ratchet wrench that would adapt more effectively to locking U-joint structures primarily for that said rotatable ratchet gear of said ratchet wrench 1 of FIG. 1, although anyone skilled in the art could easily adapt the following structures of FIGS. 4 through 7 to that said rotatable pawl ratchet wrench 16 of FIG. 2.

Figures 4, 4A:
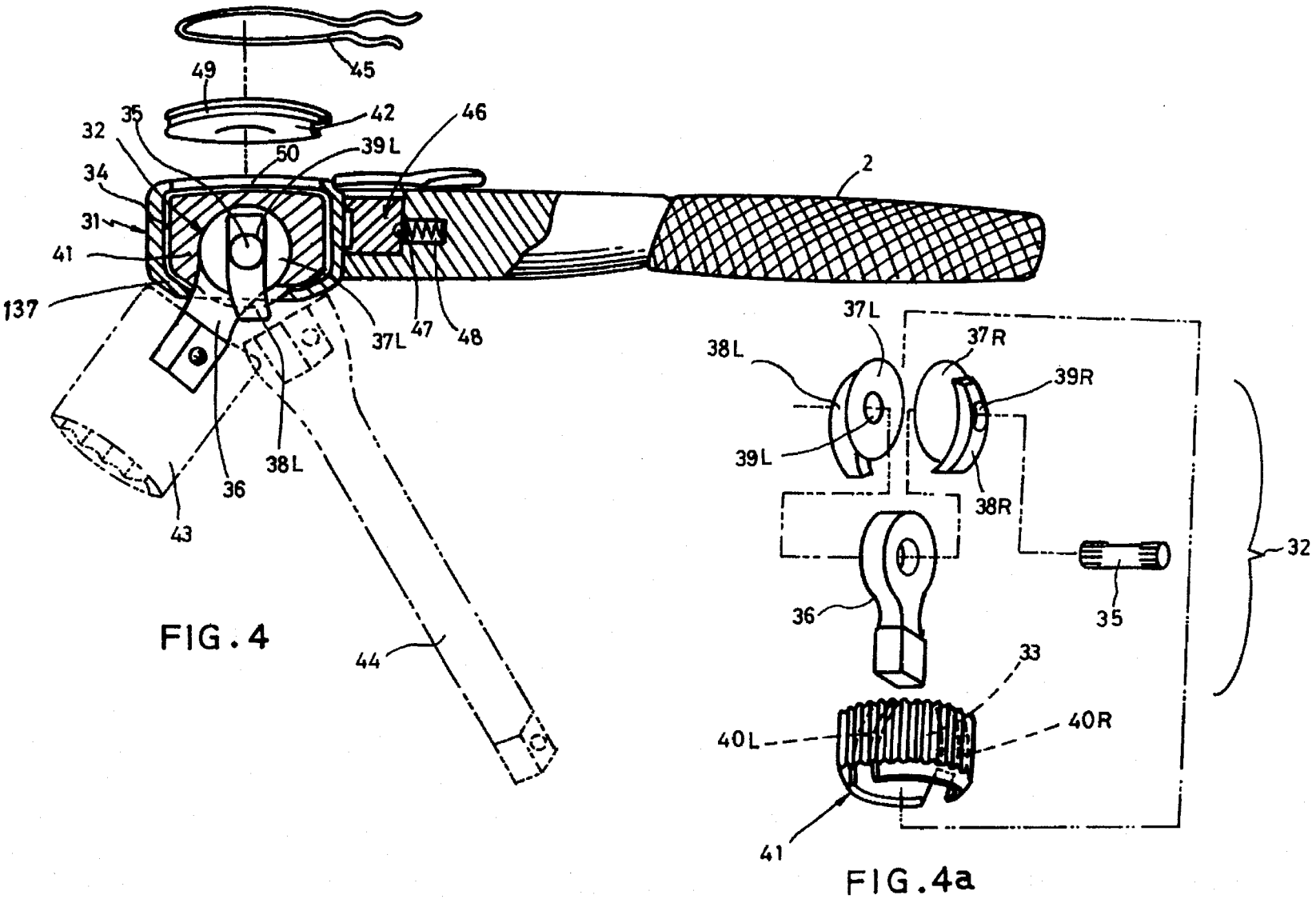
FIG. 4 is a partially exploded, angular cutaway perspective of a ratchet wrench having an internally slotted ratchet gear that comprises a U-joint socket tang, structurally modified from that of FIG. 1.
FIG. 4A is an exploded angular perspective of the U-joint socket tang components of the ratchet described in FIG. 4.

Note FIG. 4 and FIG. 4A, a second preferred U-joint depicted within ratchet wrench 107, comprising U-joint socket drive support means 32, also referred to and defined as a socket tang swivel mount means 32 being received by a spherical cavity 33. Said support means 32 comprises U-joint pin 35, socket tanged donut portion 36, oscillatorily joined between two semi-spherical joint caps, hereinafter also referred to as right joint cap 37R and left joint cap 37L having right pivot prong 38R, left pivot prong 38L and right U-joint cap aperture 39R and left U-joint cap aperture 39L. Said pivot prongs 38R and 38L pivot in right tang slots 40R and 40L, respectively, of U-joint ratchet gear 41. Wrench recess 34 rotatably receives said ratchet gear 41 which rotatably abuts, and is axially retained at annular abutment 46. Said wrench recess 34 has annular groove 50 into which annular retainer ring 45 fits on one side, the other side fitting within the annular groove 49 of recess cap means 42. Pawl mechanism 137 comprises pawl ballbearing 47, ballspring 48, which is used in conjunction to lock or free rotation of said U-joint ratchet gear 41.

Ghost lines of socket 43 and socket extension 44 depict the range of U-joint motion of said socket tang donut portion 36. This embodiment does not include socket tang locking means.

FIGS. 5, 5A, 6A 6B 6C and FIG. 7 depict the invention as further comprising locking means for the said U-joint socket drive support means 57. Noting ratchet wrench 51 of FIG. 5 and FIG. 5A, winged lock screw means 52 has threads 53, wing 54 and male conical mating wedging protuberance 55. Said lock screw means 52 enters along plane X—X into ratchet gear threaded cavity 56 of said U-joint ratchet gear 8. Said conical male protuberance 55 mates upon rotation of said wing 54 by, for example, a wrench user's fingers or even adjustable wrench jaws, with the conical female indentures 58 of the upper ball portion 110 of socket tanged, bifurcated ball joint 59. Interposed between ball joint bifurcations 60 is a double-pin donut portion 61 comprising right and left pins 62. Said right and left pins 62 rotatably nest in ratchet gear pin slots 67, and as well, rotatably abut annular bevel; flange 69, located on the lower circumference of said wrench head recess 34. This enables the socket tang 73 to swivel on the said ball socket bifurcations 60, while the said U-joint ratchet gear 57 is rotating in said wrench head recess 34.

In assembly pin means 66 enters bifurcation apertures 65 along assembly hash line 63 through donut portion aperture 64. Said bifurcation ball joint 59 then inserts into partial sphere cavity 68 located in said U-joint ratchet gear 57, which gear, after being inserted into said wrench head cavity 34 is enclosed and stabilized by wrench head annular cap means 71, as annular retaining ring means 70 joins grooves 72A and 72B. In order that a wrench user's fingers or turning tool may more easily reach said wing 54, the top rim of said U-joint ratchet gear 57 has a bevel rim portion 74.

Figure 6A:
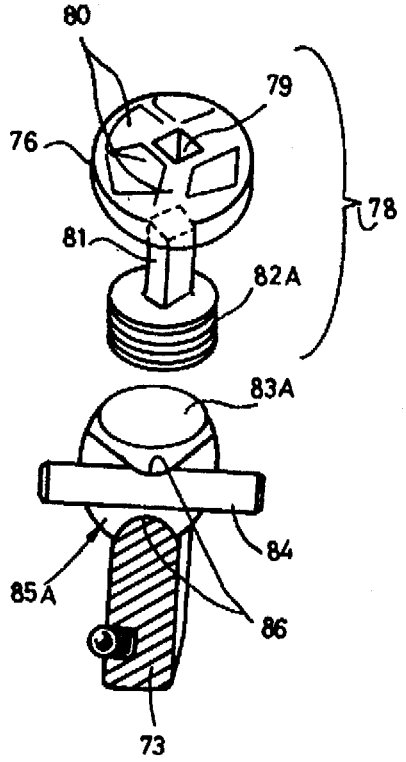
FIG. 6A is an exploded angular cutaway perspective drawing of the components of an alternate, locking ball type U-joint utilizing an apertured, axially stationary rotatable locking cap means and tanged locking screw.
Figure 6B:
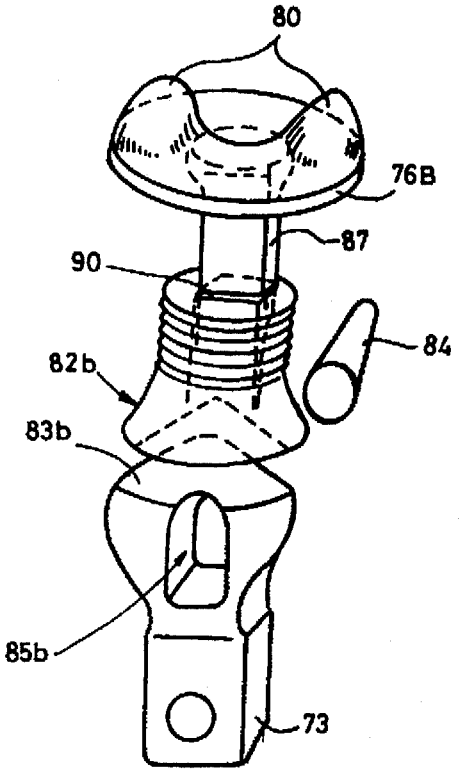
FIG. 6B is an exploded angular perspective of the components of an alternate locking, ball type U-joint utilizing a non-cylindrically pronged, axially stationary, rotatable locking cap means and apertured locking screw means.
Figure 6C:
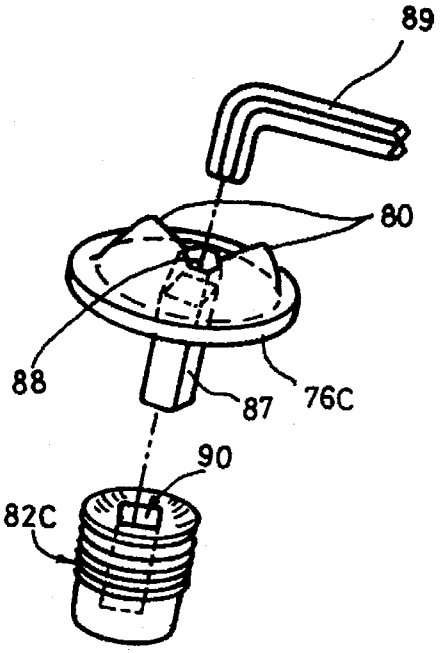
FIG. 6C is an exploded angular cutaway perspective of the components of 6B further including a wrench/screwdriver aperture, in the locking cap head, for torquing purposes.

In FIGS. 6A, 6B, 6C, note various modifications of threaded tang locking means. In FIG. 6A, locking screw means 78 comprises an apertured cap means 76A having a non-cylindrical aperture 79, gripping wings 80, and receives a non-cylindrical prong 81, said prong 81 being integral to a flat surface wedging screw portion 82A. When flat headed ball joint 83A meets said flat surface screw portion 82A, as said apertured cap means 76A is rotated, moving said screw portion 82A downward, the swiveling motion provided to said socket drive tang 73, afforded as swivel pin 84 pivots upon swivel slot pivots 86, located in swivel slot 85A, is gradually limited until a full lock-down of the said surfaces stops swivel U-joint movement of said tang 73, completely.

FIG. 6B operates similarly to the basic, same structure of FIG. 6A, however modified to include a non-cylindrical prong, as integral to a non-apertured cap means 76B, which may be rotated by a wrench user to tighten female conical screw portion 82B upon conical wedging ball joint 83B, as said prong 87 is axially extended into said non-cylindrical slot 90 to provide rotational drive to said conical screw portion 82B. Note axially elongate swivel pin aperture 85B, which comprises no said swivel slot pivots 86, as shown in FIG. 6A, into which said swivel pin 84 enters for support structure as would said support means components numbered as follows: 7A, 7B, 35, 62, and 66 of FIG. 1, FIG. 2, FIG. 4, FIG. 5, and FIG. 5A, respectively, demonstrate.

FIG. 6C, a close structural correspondence to FIG. 6B, adds a non-cylindrical wrench slot 88 in the top of pronged cap means 76C, whereinto non-cylindrically headed, insertable wrench 89 may be fitted, used additionally with said wings 80 to either loosen or tighten flat surfaced wedging screw portions 82C, which comprise a said non-cylindrical slot 90 that receives, axially, said non-cylindrical prong 87.

Figure 5:
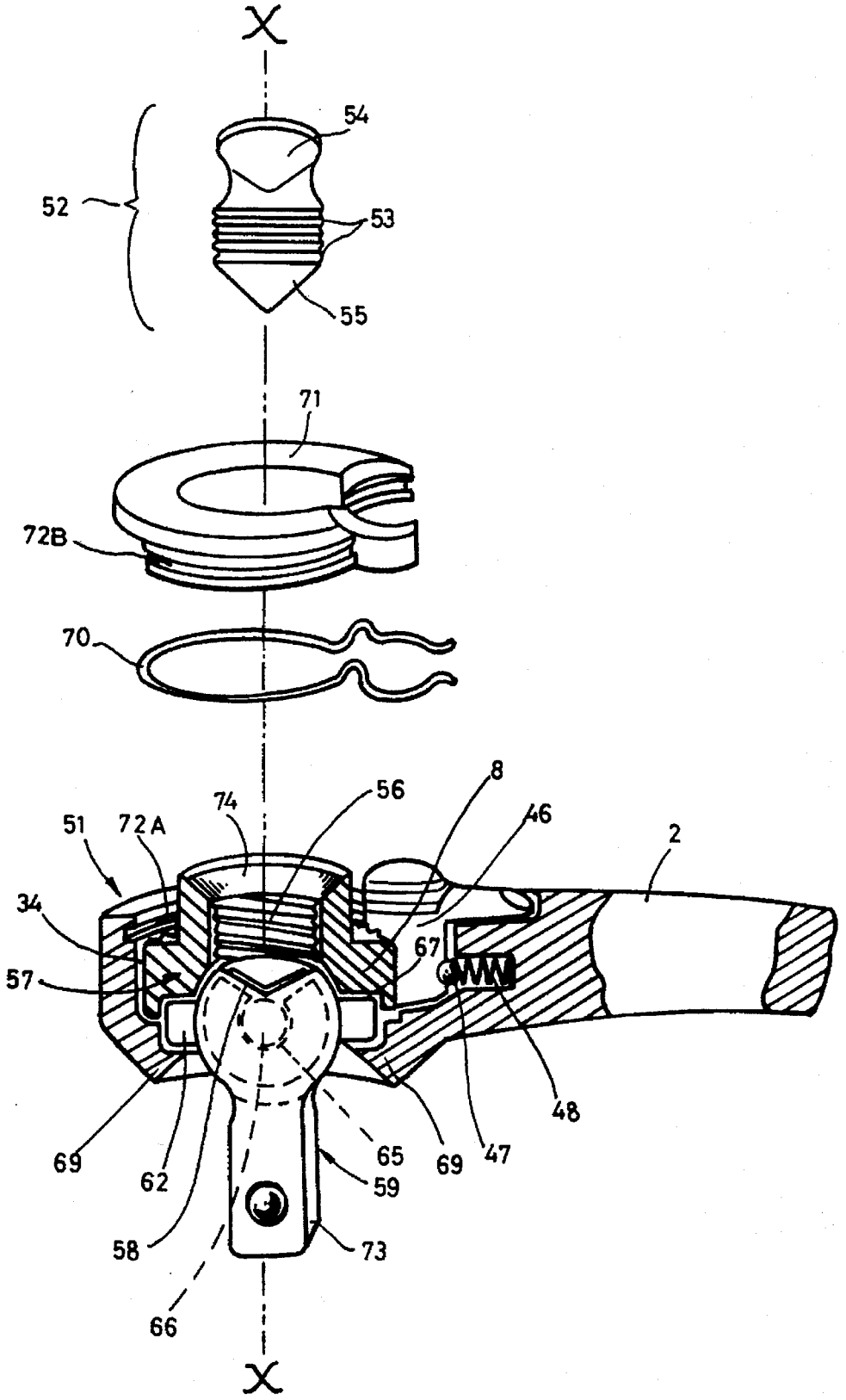
FIG. 5 is an angular, exploded, cutaway perspective drawing of a socket ball type, screw locking means U-joint in a ratchet wrench modification to that of FIG. 1.
Figure 7:
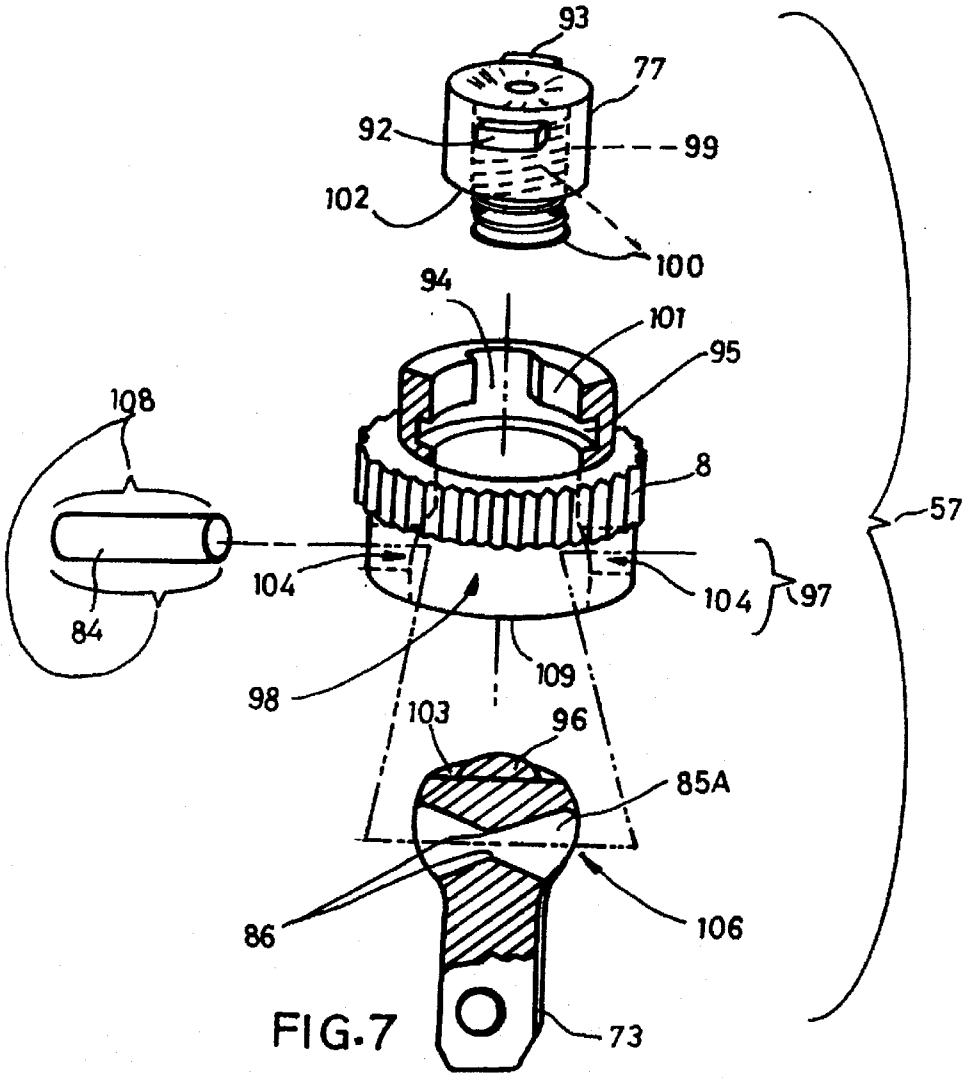
FIG. 7 is an angular exploded cutaway perspective drawing of a modified, ball type, press and lock, spring biased locking type U-joint structurally compatible with the ratchet wrench U-joint gears depicted in FIG. 1 and FIG. 5.

Lastly, FIG. 7 is the first preferred locking means embodiment and comprises a lockable, said U-joint socket drive tang support means 57, to be used in conjunction with a wrench support structure provided in FIG. 5. In other words, the embodiment of FIG. 7 may substitute equally with FIG. 5A's said U-joint socket drive tang support means 57, which would also include substitution of the said winged lock screw means 52 of FIG. 5. Note how press and twist tang lock button 77 comprises button protuberances 92 extending from the sides thereof, which slide axially in gear head aperture 101, while additionally being guided in axial groove means 94 until reaching annular protuberance receiving groove 95. As a wrench user's finger presses upon the knurled portion to that point, additionally applying twist motion to the said lock button 77 is causing the said button protuberance 92 to axially lock, against the biasing action of spring 100, which is located in the spring recess 99. Swivel ball 106 comprises annular flat wedging surface 103 whereat the lower wedging rim portion 102 of said button protuberance 92 will meet in mutually rotaatble, flush contact. A stop portion (not shown) is provided for said button protuberance 92, when in a swiveling tang mode. Raised portion 96 simply keeps said spring 100 fixed upon itself so that the swiveling motion of said socket drive tang 73 always has a biasness toward a generally perpendicular position with respect to said ratachet wrench handle 2.

Figure 5A:
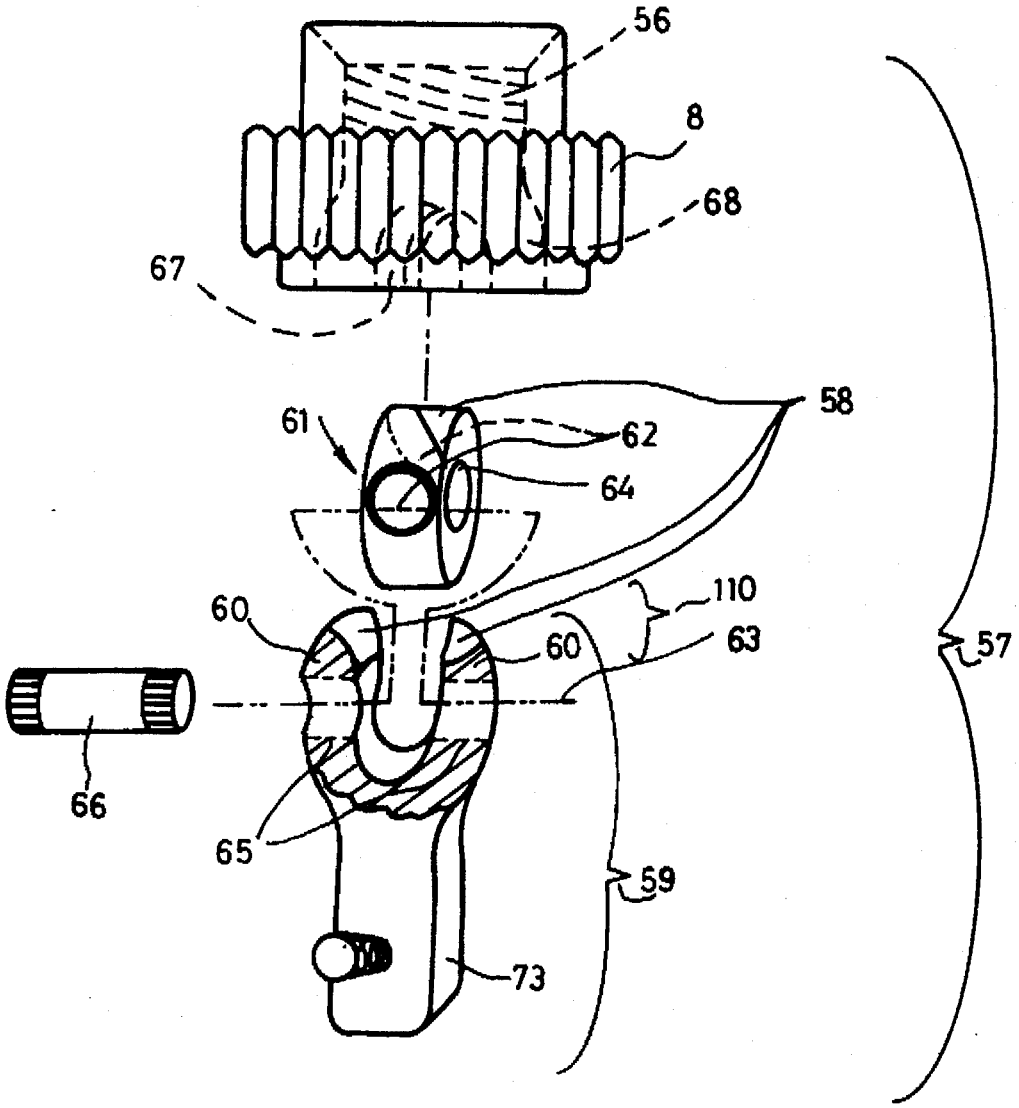
FIG. 5A is an angular cutaway exploded perspective of a rotatable ratchet gear and screw locking means U-joint components of FIG. 5.

Said swivel pin 84 of FIG. 7, unlike the said pin means 62 and said ratchet gear pin slots 67 of FIGS. 5, and 5A, respectively, enters said u-joint ratchet gear means' 57 lower end 97 into swivel pin holes 104 and the long sides 108 of said swivel pin 84 then rotatably abut said annular bevel flange 69 of FIG. 5, but are completely affixed within the bottom portion 109 of said rotatable gear 8. Partialy spherical recess 98 approximates the structure of a the said partial sphere cavity 68 of FIG. 5A.

It is to be understood that the form of the invention herewith shown and described above is to be taken as preferred embodiments. Various changes may be made in the shape, size and arrangement of parts, for example: other equivalent elements may be substituted for those illustrated and described herein, parts and elements may be reversed and certain features of the invention may be utilized indepedently of the use of other features, all without departing from the spirit or scope of the invention, as defined in the subjoining claims.

In construance of the adjoining claims, it is intended that the basic invention of including a universal joint or U-joint socket tang as a permanent appendage within the head of the ratchet wrenches herein described (which wrenches are intended to be general representatives of all those ratchet wrenches in present use), and those means to lock or unloose the said U-joint socket drive support means 57, for example, in a said ratchet gear 8, for example, in FIGS. 5, 5A, 6A, 6B, 6C, and FIG. 7, to be general representatives of the subject invention and applicable to various other structurally modified forms.

I claim:

1. A ratchet wrench apparatus comprising:

a wrench body having a handle whereby a wrench user may manipulate said handle to apply rotational torque to a fastener;

a ratchet wrench head, said ratchet wrench head having a cylindrically recessed head portion;

a dual-directionally rotatable ratchet gear received in said cylindrically recessed head portion of said ratchet wrench head;

a socket drive support having an integral U-joint, said socket drive support and said U-joint assembled in said wrench head such that when assembled said U-joint is both axially non-slidable and axially non-detachable with respect to said wrench head;

a retaining assembly, said retaining assembly retaining said ratchet gear within said recessed head portion; and a pawl assembly, said pawl assembly operatively affixed within said wrench body and engageable with said ratchet gear.

2. The wrench according to claim 1, wherein said U-joint further comprises a bifurcated ball joint and a double pin donut portion hingeably received in said bifurcated ball joint;

said double pin donut portion further having right and left pins rotatably nesting in ratchet gear pin slots in said ratchet gear;

said bifurcated ball joint and said double pin donut portion further including apertures receiving a pin, permitting said socket drive support full U-joint swiveling motion; and said socket drive support further comprising a tang having a biased ball bearing whereby a wrench socket may be axially restrained thereon.

3. The wrench according to claim 2, further comprising:

a lock, said lock comprising a threaded and winged locking screw, said locking screw having a wedging surface cooperable with a wedging surface located on said bifurcated ball joint; and further comprising a threaded ratchet gear cavity to threadingly receive said winged locking screw.

4. The wrench according to claim 3 wherein said wedging surfaces of said bifurcated ball joint and said locking screw comprise female and male conical surfaces, respectively.

5. The wrench according to claim 2 further comprising a lock, said lock comprising a threaded locking screw having threads mating with threads of an internally threaded ratchet gear cavity; and said threaded locking screw and a portion of said ball joint have mating wedging surfaces integral therewith.

6. The wrench according to claim 5 wherein:

said ball joint may pivot when said mating wedging surfaces are unengaged; and said mating wedging surfaces are generally conical surfaces.

7. The wrench according to claim 1 further comprising:

a lock, said lock comprising a threaded locking screw having outer threads mating with threads of an internally threaded ratchet gear cavity; and said threaded locking screw and a portion of said U-joint have mating wedging surfaces integral therewith.

8. The wrench according to claim 1, further comprising:

two tang slots located in said ratchet gear;

said U-joint includes a donut portion and two semi-spherical joint caps, said donut portion pivotally joined between said two semi-spherical joint caps;

each of said semi-spherical joint caps having a pivot prong extending therefrom, each of said pivot prongs pivotally received in one of said two tang slots;

apertures in both said joint caps and said donut portion;

a U-joint pin fixed in said apertures, permitting said U-joint full U-joint swiveling motion.

9. The wrench according to claim 7 wherein said locking screw comprises a wedging screw whereby said screw may be rotated to actuate said lock and wherein said wedging surfaces of said locking screw and said U-joint are first and second wedging surfaces, respectively.

10. The wrench according to claim 9 wherein said first and second wedging surfaces are generally flat.

11. The wrench according to claim 9 wherein:

said u-joint further comprises a swivel ball;

said first wedging surface on said locking screw is a conical indentation on said locking screw; and said second wedging surface is a conical protuberance on said swivel ball.

12. The wrench according to claim 9 wherein:

said threaded locking screw further has a non-cylindrical aperture therethrough; and further comprising:

a winged cap having a non-cylindrical prong integral therewith, said non-cylindrical prong being slidable within said cylindrical aperture; and said winged cap further comprising a non-cylindrical wrench slot whereby a wrench may be inserted to provide additional rotating torque and leverage.

13. The wrench according to claim 7, wherein:

said locking screw further comprises a non-cylindrical prong integral therewith;

said wedging surface of said locking screw may be wedged into mating contact with said wedging portion of said U-joint, said wedging contact being induced by rotating a non-cylindrically apertured cap having gripping wings to allow said non-cylindrical prong axial access through said apertured cap, thus concurrently rotating and axially driving said locking screw to wedging or non-wedging surface contact.

14. A ratchet wrench apparatus comprising:

a wrench body having a handle whereby a wrench user may apply rotational torque to a fastener;

a ratchet wrench head, said ratchet wrench head comprising a cylindrically recessed head portion having an inner circumference, said inner circumference of said head portion having ratchet gear teeth circumscribed thereon;

said ratchet wrench apparatus further rotatably receiving a dual-directionally rotatable ratchet pawl within said ratchet wrench head and in contact with said gear teeth, said rotatable ratchet pawl further comprising a socket drive tang support integrally attached thereto in a fixed axial relationship, said socket drive tang support having an integral U-joint such that said U-joint is integrally attached to said wrench head;

a retaining assembly, said retaining assembly retaining said ratchet pawl within said recessed head portion; and a pawl actuator affixed to said ratchet pawl and accessible by a wrench user's fingers to selectively engage a pawl in and out of engagement with said ratchet gear teeth.

15. The wrench according to claim 14, wherein:

said ratchet pawl having a recess with swivel pin holes in a wall thereof;

said U-joint including a swivel ball;

within said swivel ball is located a swivel slot; and said swivel slot swivelably receiving a swivel pin, said swivel pin supported in said swivel pin holes.

16. A pneumatically operated ratchet wrench apparatus comprising:

a wrench body having a handle whereby a wrench user may apply rotational torque to a fastener;

a ratchet wrench head comprising a cylindrically recessed head portion;

a dual-directionally rotatable assembly received in said recess, said rotatable assembly further comprising a socket drive support tang having an integral U-joint, said socket drive support tang and said U-joint integrally attached to said rotatable assembly such that when assembled, said U-joint is non-detachable from said rotatable assembly;

a pneumatically controlled drive operatively joined to said cylindrically recessed head portion, providing rotational drive torque to said dual-directionally rotatable assembly;

an actuator for selectively activating said drive; and a retaining assembly, said retaining assembly rotatably retaining said rotatable assembly within said ratchet wrench head.

17. The wrench according to claim 16, further comprising wherein:

said rotatable assembly comprises a dual-directionally rotatable ratchet pawl; and said ratchet pawl contacting gear teeth circumscribed on a wall of said cylindrically recessed head portion.

18. The wrench according to claim 16 wherein said u-joint is both axially non-slidable and non-detachable from said rotatable assembly.

19. A hand-held ratchet wrench comprising:

a wrench body having a handle;

said wrench body having a recessed head therein for receiving a rotatable member;

a rotatable member affixed in said recessed head;

a ratchet assembly affixed to one of said wrench body or rotatable member and ratchet teeth affixed to said other of said wrench body or said rotatable member;

a U-joint support tang integrally attached to said rotatable member such that said U-joint support tang is axially non-slidable and axially non-detachable from said rotatable member.

* * * * *